US005806602A

United States Patent [19]

Ros

[11] Patent Number: 5,806,602

[45] Date of Patent: Sep. 15, 1998

[54] DEVICE FOR THE EXTINCTION OF FIRES ON THE BASIS OF QUICK-ACTING AIR FOAM

[75] Inventor: Daniel José Ros, Guaymallén, Argentina

[73] Assignee: Instalco S.R.L., San José, Argentina

[21] Appl. No.: 768,895

[22] Filed: Dec. 17, 1996

[30] Foreign Application Priority Data

Dec. 20, 1995 [AR] Argentina ..... 334.725

[51] Int. Cl.[6] ..... A62C 35/02

[52] U.S. Cl. ..... 169/9; 169/13; 169/15

[58] Field of Search ..... 169/5, 9, 13, 14, 169/15

[56] References Cited

U.S. PATENT DOCUMENTS 3,750,754 8/1973 Stults ..... 169/15 X
5,031,834 7/1991 Simpson ..... 169/15 X

*Primary Examiner*—Andrew C. Pike
*Attorney, Agent, or Firm*—Evenson, McKeown, Edwards & Lenahan, PLLC

[57] ABSTRACT

A fire extinction device uses water which is driven by compressed air. Upon passing the water through a dosing apparatus, where the water is mixed with a foaming liquid, the air foam is generated and then expelled through a foam spout. The device includes, among other elements, an air compressor, a first tank containing the water, a second tank containing the foaming liquid, and a fire hose through which the water and foaming liquid mixture passes.

2 Claims, 1 Drawing Sheet

DEVICE FOR THE EXTINCTION OF FIRES ON THE BASIS OF QUICK-ACTING AIR FOAM

The present invention refers to a device for the extinction of fires by using the so called air foam, especially a device for the use in service or fuel selling stations and/or fuel, lubricant, oil or foodstuff deposits, etc. The new device allows to reach practically, economically and securely all locations where liquid fuels and lubricants for automobiles and trucks are stored in order to be sold or dispatched. In these locations, that are highly dangerous in the case of fires, electric energy for the extinction of fires is probably not available, which is typical when such a fire accident occurs.

The present invention is related to the solution of a problem that occurs when a fire is breaking out in locations where highly inflammable liquids are stored and where at the same time working staff and clients are present. These locations are generally equipped with tanks having various fuel outputs in different sites, as well as lubricant tanks and lubricant sales points, thereby causing the risk that fires may break out simultaneously in different sites of the same location. In these locations, normally large electrical extinction systems completely depending on an intact supply of electric energy are used. But the electric current usually is cut by a fire already in the moment when the fire breaks out, thus, leaving the fire fighting only to manual extinguishers until the fire brigade arrives. In locations with elements of a high combustibility where a fire propagates in a very short time, it is necessary to have extinction means that are simple, safe, and quick-acting and that allow to cover the variety of sites of the location requiring an extinction of fire. These extinction means must be basically in conditions to be driven with or without electrical energy.

The same device can be used with very good results in passenger or goods transport vehicles. The extinguishers used in cars are using chemical powder which in the case of burning upholstering elements or similar elements is putting out the flames but leaving a glow. These extinguishers do not cool the burning objects, and, thus, the fire may break out again due to an air contact of the glow.

In one preferred but not exclusive embodiment the present device comprises an assembly of means being described below and making reference to the illustrative drawings.

Figure 1:
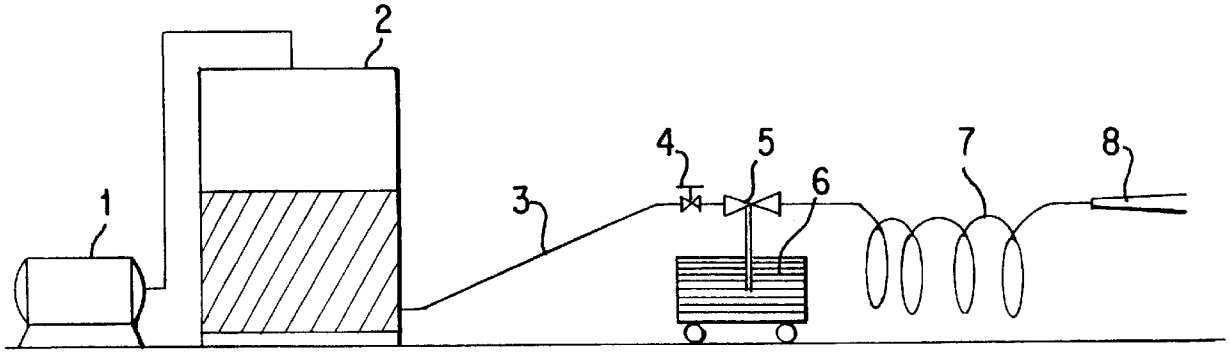
Figure 2:
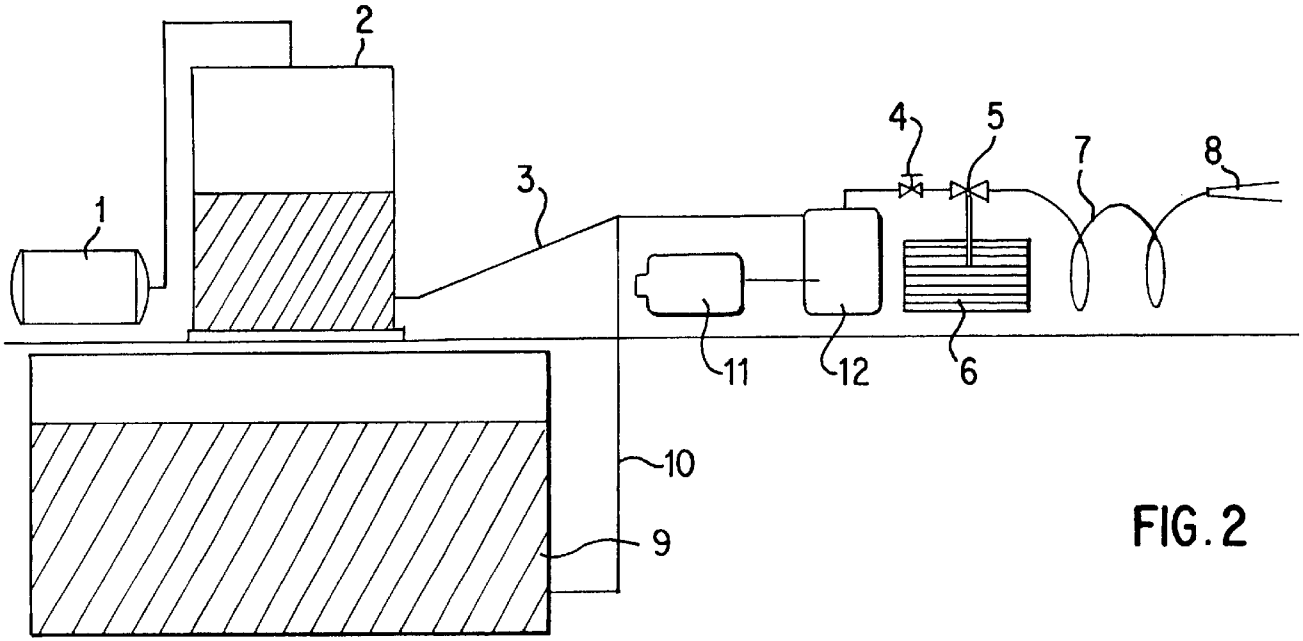

For a better understanding of the present invention reference is made to the drawings in which FIG. 1 shows a sectional profile view of the elements which form the device for the extinction of fires on the basis of quick-acting air foam; and FIG. 2 shows a sectional profile view of a combined device for the extinction of fires on the basis of quick-acting air foam.

The present device comprises—in one preferred but not exclusive embodiment—an assembly of means including:

- a main tank of a suitable capacity for the storage of water, the tank further having a compressed air supply which maintains a constant pressure inside the tank, thus, requiring an air compressor which is generally available in all service stations or similar;
- a rigid conduit of variable length, according to the size of the location to be covered;
- a small auxiliary tank containing the foaming liquid;
- a foaming liquid dosing apparatus or ejector; and
- a fire hose with a foam spout end.

In relation with the drawings and for a better understanding the following references are used in the figures:

(1) the air compressor, (2): the main tank containing water and compressed air, (3): the rigid conduit through which the water leaves the tank, (4): a straight-way water cock, (5): the foaming liquid dosing apparatus or ejector, (6): the auxiliary tank containing the foaming liquid, (7): the fire hose and (8): the foam spout.

The device for the extinction of fires on the basis of quick-acting air foam is described in the following making now reference to FIG. 1:

The compressed air provided by the compressor (1) maintains the main tank (2) permanently pressurized. Upon opening the straight-way water cock (4) the water contained therein is driven to flow through the rigid conduit (3), passing through the foaming liquid dosing apparatus or ejector (5). This foaming liquid dosing apparatus or ejector (5) provides by means of the Venturi tube principle the desired dose of foaming liquid or emulsifier liquid from the auxiliary tank (6) to be mixed with the water. This emulsion enters the fire hose (7) which has a foam spout (8) in its output end. Upon arriving at the foam spout (8) and contacting the air, the emulsion generates a powerful foam jet. By directing this foam jet to the fire seat, the fire will be extinguished.

The main advantage of using this device resides in the security of always having the required energy to produce the water stream, even in the case that the breaking out of the fire has cut the electric current supply.

To operate the present device the air compressor (1) will have to maintain a constant air pressure within the main water tank (2). This main tank (2) will be preferably located in places from which the sites where the fire seats probably may occur, are accessible. On the other hand, the straight-way water cock (4) for opening the water output of the main tank (2) in order to mix the water with the foaming liquid is located in places where it is easily and quickly accessible to the working staff of the station. In these places also the fire hose (7) with the foam spout (8) should be wound up, such that the acting person can, nearly simultaneously, take the fire hose (7) and operate the cock (4), thus directing immediately a jet of air foam over a distance of up to 20 m to a fire seat. Consequently, the probability, to extinguish quickly any fire that has broken out, will be very high.

The most important features to be emphasized are: the constructive simplicity with the resulting economy, the simple handling, and the security of the equipment, which does not require any preparation of the person applying it.

The above described device can be used in different ways as well as a combined device for the extinction of fires on the basis of quick-acting air foam can be used, such as schematically shown in FIG. 2, by attaching to the above described device:

- a complementary tank (9), from which the water can be extracted;
- a pump (12) driving the water from said complementary tank (9) to the ejector; and
- a motor (11) of any type driving the pump (12).

This embodiment can be operate alternately or in addition with the already described device shown in FIG. 1.

There is also the possibility to use the device of the present invention, in passenger and/or goods transport vehicles. In these vehicles the air depot of the braking system will be used. The depot should be slightly extended in order to give it the required capacity. Furthermore, a small water and compressed air tank must be attached and, in addition, also a small auxiliary tank for the foaming liquid. Using this new device in transport vehicles will result in a higher number of successful extinctions of fires that may possibly occur in such vehicles.

The different ways of using the present device depend on various factors, such as the availability of installations, the available space, the dimensions of the location to be protected, the extent of additional security pretended, etc. Each of these factors should be taken into account with the corresponding calculations, resulting in the required diameters, volumes, and lengths of the conduits. The elements used in the present invention are preferred ones, but can be replaced by others fulfilling the same function.

What is claimed is:

1. A device for extinction of fires on a basis of quick-acting air foam, the device comprising:

an air compressor connected to a first tank containing water and compressed air of sufficient quantity to expel the water contained therein;

a rigid conduit leaving through a lower part of the first tank, having in an opposite end thereof a liquid interrupting cock and being connected to a foaming liquid dosing apparatus or ejector, said foaming liquid dosing apparatus or ejector receiving a foaming liquid through a conduit connected to a second tank located in a lower part of said foaming liquid dosing apparatus or ejector; and a fire hose with a sufficient extension that is connected to said foaming liquid dosing apparatus or ejector, said fire hose terminating in a foam spout where an air foam jet is generated.

2. The device for the extinction of the fires on the basis of the quick-acting air foam according to claim 1 further comprising:

an additional liquid tank containing liquid;

said liquid being obtained from said additional liquid tank by a motor-driven pump; and said air foam jet being generated by passing the liquid through the dosing apparatus.

* * * * *